US012391419B2

(12) United States Patent
Starkmann

(10) Patent No.: US 12,391,419 B2
(45) Date of Patent: Aug. 19, 2025

(54) METHOD AND APPARATUS FOR MARKING MATERIAL BALES

(71) Applicant: Kadant PAAL GmbH, Georgsmarienhütte (DE)

(72) Inventor: Jürgen Starkmann, Osnabrück (DE)

(73) Assignee: Kadant PAAL GmbH, Georgsmarienhütte (DE)

( * ) Notice: Subject to any disclaimer, the term of this patent is extended or adjusted under 35 U.S.C. 154(b) by 431 days.

(21) Appl. No.: 17/925,029

(22) PCT Filed: May 7, 2021

(86) PCT No.: PCT/EP2021/062193
§ 371 (c)(1),
(2) Date: Nov. 14, 2022

(87) PCT Pub. No.: WO2021/233700
PCT Pub. Date: Nov. 25, 2021

(65) Prior Publication Data

US 2023/0166879 A1 Jun. 1, 2023

(30) Foreign Application Priority Data

May 19, 2020 (DE) ..... 10 2020 113 503.3

(51) Int. Cl.
*B65B 13/18* (2006.01)
*B65B 13/26* (2006.01)
*B65B 27/12* (2006.01)

(52) U.S. Cl.
CPC ..... *B65B 13/182* (2013.01); *B65B 13/26* (2013.01); *B65B 27/12* (2013.01)

(58) Field of Classification Search
CPC ..... B65B 13/182; B65B 13/26; B65B 13/28; B65B 27/12; G09F 3/14; A01F 15/14; B65C 7/00
See application file for complete search history.

(56) References Cited

U.S. PATENT DOCUMENTS

| | | | | |
|---|---|---|---|---|
| 295,799 | A * | 3/1884 | Patton | G09F 3/14 24/601.5 |
| 2014/0157999 | A1 | 6/2014 | Verhaeghe et al. | |
| 2016/0332757 | A1 | 11/2016 | Lechevalier | |
| 2018/0014467 | A1* | 1/2018 | Lang | G09F 3/206 |
| 2019/0002151 | A1 | 1/2019 | Coen et al. | |

FOREIGN PATENT DOCUMENTS

| | | |
|---|---|---|
| CA | 2035288 | 8/1991 |
| EP | 0 442 302 | 8/1991 |
| EP | 2 707 297 | 11/2012 |

* cited by examiner

*Primary Examiner* — Jimmy T Nguyen
(74) *Attorney, Agent, or Firm* — Gudrun E. Huckett

(57) ABSTRACT

The invention relates to a method for marking material bales (2), in which method a pressed material bale (2) is tied up by means of a binding device (22) using a binding material (4), and the binding device (22) produces at least one knot (6, 6*a*, 6*b*) in the binding material (4) wrapped around the material bale (2), wherein a label (8) is fixed to the binding material (4) as an information carrier. The label (8) is supplied to the binding device (22), and at least a part of the label (8) is incorporated into the knot (6, 6*a*, 6*b*).

23 Claims, 6 Drawing Sheets

METHOD AND APPARATUS FOR MARKING MATERIAL BALES

BACKGROUND OF THE INVENTION

The present invention concerns a method for marking material bales in which a pressed material bale is tied by a tying material by means of a tying device, wherein the tying device produces at least one knot in the tying material wrapped around the material bale and a label as an information carrier is fastened to the tying material, as well as the material bale itself. Moreover, the present invention concerns a marking apparatus for marking a material bale, which is to be tied by means of a tying device with the tying material with production of at least one knot in the tying material, by attaching a label serving as an information carrier to the tying material and a material bale press comprising such a marking apparatus.

In the waste management industry, material bale presses for compacting waste material are used in order to transport and store the latter in a space-saving way in the form of pressed material bales, i.e., in particular square bales such as waste bales or recyclable material bales comprised of one or a plurality of materials. In this context, conventional presses are capable of processing a plurality of materials with different properties, e.g., paper, cardboard, or recyclable plastic materials. For an optimal return of the waste material into the recycling loop, knowledge of the logistic data-such as e.g. material composition, weight and/or production date of the respective press batch-is of central importance. Therefore, the material bales are individually marked in practice which facilitates logistic processes significantly. The marking is realized in general by attaching a label serving as an information carrier to a tying material which is wrapped around the material bale and ties the latter and, for example, is embodied as wire or yarn.

Up to now, in many places material bales are still marked by manual attachment of labeled paper labels to the bales themselves or to the tying material, which constitutes a significant labor expenditure. In addition, during the course of the further transport and the storage of the bales, the labels often become damaged and soiled and, as a result, become unreadable.

In the field of agricultural bale presses, marking apparatuses are known with which adhesive labels are automatically fastened to the tying material, such as e.g. shown in EP 2 707 297 A1. In this context, on an already finished, i.e., pressed and tied, straw or hay bale, the tying material is lifted by means of a lifting mechanism away from the bale toward a labeling machine and there provided with an adhesive label prior to returning it into its initial position. For reliable realization of the lifting movement and marking, a plurality of, sometimes movable, components is however required which take up a lot of installation space, e.g., lifting arms, tensioning devices as well as supply and fastening means for the labels.

It is therefore object of the invention to provide an improved automated method for marking material bales. Moreover, it is the object of the present invention to provide an improved marking apparatus. Moreover, it is the object of the present invention to provide an improved material bale press with which material bales can be marked advantageously. Furthermore, the present invention has the object to provide an improved marked material bale.

SUMMARY OF THE INVENTION

This object is solved by a method for marking material bales in which a pressed material bale is tied by means of a tying device with a tying material, wherein the tying device produces in the tying material wrapped around the material bale at least one knot, wherein a label as an information carrier is fastened to the tying material, wherein the method is characterized in that the label is supplied to the tying device and at least one part of the label is incorporated into the knot. Moreover, the object is solved by a marking apparatus for marking a material bale, which is to be tied by means of a tying device with a tying material with production of at least one knot in the tying material, by attaching a label serving as an information carrier to the tying material, in particular for performing a method according to the invention, wherein the marking apparatus is characterized by a storage for labels serving as information carrier as well as a dispensing mechanism which transports a label from the storage into a dispensing position, respectively, wherein in the dispensing position of the label at least one part of the label can be incorporated into the knot during the course of knotting. Furthermore, a material bale press, comprising a tying device for tying a pressed material bale with a tying material with production of at least one knot in the tying material, which is characterized by a marking apparatus according to the invention and a pressed material bale which is tied with a tying material, wherein the tying material is knotted with at least one knot and a label as an information carrier is fastened to the tying material, and which is characterized in that at least one part of the label is incorporated into the knot are subject matter of the invention.

The method according to the invention is characterized in that the label is supplied to the tying device and at least one part of the label is incorporated into the knot.

For this purpose, the label is positioned in such a way in relation to two strands of the tying material to be joined to a knot, in particular sufficiently close to the strands, so that during the course of knotting at least one part of the label is clamped by at least one of the strands or strand sections and/or, in particular by means of a knotting or twisting tool of the tying device, is clamped together with at least one of the strands or strand sections, wherein the label in the finished knot is held by friction by at least one of the strands. The supply of the label to the tying device is realized in this context e.g. in that the label is supplied to the strands or strand sections of the tying material to be joined to a knot and/or to the tying or twisting tool of the tying device. In this manner, a reliable marking of the material bales is possible, wherein use is made of the means of the tying devices that are already present for joining the two strands of the tying material. In implementing this novel marking method, no additional components that move or tension the tying material are thus required, whereby a significant amount of installation space can be saved. The label is incorporated into the knot preferably only by the means of the tying device present anyway for joining the two strands of the tying material, whereby the marking method is significantly simplified because only the supply of the label to the tying device must be implemented.

A further advantage of the method according to the invention is that it can be implemented temporally parallel to tying of the material bale so that the entire process course of producing the pressed material bale is not prolonged by the step of marking. Moreover, in the method according to the invention the use of any type of adhesive for safe fastening of the label to the tying material can be dispensed with.

In the meaning of this invention, knots in the classical sense as well as connections that are produced by twisting of strands are to be understood as knots, wherein for the latter in the following the term "twisted knot" is used.

Preferably, the labels which are to be incorporated into the knots are made of a tear-resistant material, in particular, a tear-resistant plastic material. In this way, it is ensured that the labels can withstand the tensile and compression forces occurring during knotting and/or hold reliably as needed in a manufacturing process, during future transport or the storage of the material bales.

Preferably, a wire, for example, a metal wire or a plastic wire, is used as tying material. Due to its good plastic deformability, strands of a tying material that is present as a wire can be joined by a plurality of connection methods.

Preferably, the label serving as an information carrier contains information relating to the material bale in the form of an identifier, i.e., a feature that is linked to a certain identity for unambiguous identification of the material bale. Logistic data—such as e.g. material composition, material quality, production location, production date/time, weight and/or moisture contents of the respective pressed batch—can be correlated with the identifier that marks the material bale and that is, for example, in the form of an optical 1D, 2D or 3D code, in particular a barcode or QR code or a radio frequency-based identification, in particular an RFID identification. The correlation, for example, of logistic data stored in a database, with the identifier can be done in this context prior to, during, or after fastening of the label to the tying material. For this purpose, the label can be read out e.g. by means of a reader, wherein the identifier is recognized and the logistics data belonging to the corresponding material bale are correlated with the identifier. Alternatively or in addition, the information relating to the material bale and contained in the label comprises at least a portion of the corresponding logistic data.

In a preferred embodiment of the invention, a read-out region of the label, in and/or on which information relating to the material bale are stored or can be stored, is not incorporated into the knot, in particular wherein the read-out region projects away from the knot after producing the knot. Thus, only a portion of the label is processed into the knot, wherein another part of the label, the read-out region, is located outside of the knot and can be better readable and/or writable in this manner.

With advantage, the label is provided as a radio frequency label provided with a transponder that can be read out by radio frequency, in particular an RFID transponder. Such a radio frequency label is still readable and/or writable well even after knotting which causes the label or a portion of the label to be possibly significantly deformed. Moreover, radio frequency labels are insensitive in regard to their function with respect to possible soiling that may occur during the production process of the material bale or the further transport or the storage. Preferably, the transponder is arranged in the read-out region of the label, preferably here embedded by casting in a plastic substrate. In this manner, the transponder is not exposed to mechanical loads during knotting, which avoids the risk of damage.

Preferably, the radio frequency label is produced prior to being incorporated into the knot, in that the transponder is attached to a plastic substrate, in particular is glued on. Particularly preferred, a roll with plastic substrate and a roll with a plurality of adhesively connectable transponders are employed, wherein a certain quantity, in particular a certain length of plastic substrate, as well as a transponder are paid out from their respective roll and combined, whereby the transponder is adhesively connected to the plastic substrate. In this manner, the quantity of the plastic substrate used for the respective label can be adapted to the actual requirements and, in this way, the length of the label can be varied, for example.

According to a further preferred embodiment of the invention, at least one part of the label, preferably the entire label, is provided in the form of an elongate piece, in particular in the form of a preferably flexible strip. Due to such a geometry, the label can be incorporated particularly well into the knot, wherein the elongate piece, so to speak as a "third strand", can be supplied to the tying device and processed by the latter. Preferably, at least the part of the label that is to be incorporated into the knot is elongate. In particular, the elongate part of the label or the entire label has a length of 10 cm to 50 cm, preferably of 20 cm to 40 cm, particularly preferred of 25 cm to 35 cm. Preferably, at least a part of the label or the entire label has a width of 0.5 cm to 10 cm, preferably 1 cm to 5 cm.

Advantageously, the label embodied preferably as a flexible strip is positioned, in particular prior to knotting, for example, in a dispensing position of the label, in such a way that the label, beginning at a free end of the label which is facing the strands of the tying material, extends in an arc shape at least across one fourth of its entire length, particularly preferred at least across a third of its entire length, particularly preferred at least across one half of its entire length. Since a section of the label, in particular exclusively due to its own weight, extends in an arc shape, the label can be supplied better to the tying device, for example, positioned particularly close to the strands of the tying material, because components of the tying device such as, for example, a twisting hook or a wire pull needle, can be bypassed, as needed, in this way.

Preferably, the label, in particular an elongate part of the label, is positioned, for example, in the dispensing position of the label, substantially transversely to at least one of the strands or strand section of the tying material. In this manner, the label can be positioned precisely in relation to a certain length section of the tying material and can thus be incorporated reliably into the knot. In this context, "substantially transversely positioned" means that, between the at least one strand or strand section and the label, an angle exists that deviates from a right angle (90 degrees) by at most 30 degrees, preferably at most by 15 degrees, particular preferred by at most 5 degrees.

Preferably, the label is positioned, for example, in its dispensing position, such in relation to one of the strands of the tying material that a virtual tangent placed at its free end, from at least one perspective transversely to the strand, is positioned relative to the strand at an angle of less than or equal to 45 degrees, preferably less than or equal to 30 degrees, particularly preferred less than or equal to 20 degrees. Due to such a positioning, the label at least in sections has a minimal distance relative to the strand and can thus be gripped and processed particularly well as "third strand" by the tying device.

According to a further preferred embodiment of the invention, for producing the knot, two strands of the tying material are twisted to a twisted knot. In this type of knots, a label that is in particular partially or completely embodied as an elongate piece can be particularly well incorporated. The label is incorporated essentially as "third strand" into the knot and here is held by friction at several positions by the strands of the tying material. Preferably, for better twisting in this context, tying material that is embodied as a wire, for example, metal wire or plastic wire, is used because it can be plastically deformed well.

Preferably, for producing the twisted knot, a twisting tool of the tying device, in particular a twisting hook, is used and the label is positioned, in particular prior to knotting, for example, in its dispensing position, such that it protrudes into a working radius of the twisting tool so that, during the course of knotting, it is caught by and/or in the twisting tool, in particular in a catching slot of the twisting hook. In case of a twisting tool that is embodied as a twisting hook, the latter catches the two strands of the tying material to be joined to a knot in the catching slot in particular by a rotation movement, whereby the label and the strands are combined. In this manner, the label can be reliably incorporated into the knot. The working radius in this context is the region into which an object must protrude in order to be caught by the twisting tool, in particular in order to be caught during the rotation movement of the twisting hook in its catching slot. Preferably, in particular prior to knotting, the label and the twisting hook are positioned relative to each other, for example, in the dispensing position of the label, such that the label protrudes into the catching slot of the twisting hook.

According to a further advantageous embodiment of the invention, the label, in particular prior to knotting, is positioned, for example, in its dispensing position, in such a way that it protrudes between the two strands of the tying material to be twisted to a knot. In this manner, the strands of the tying material which have been brought beforehand, in particular by a wire pull needle or wire push needle of the tying device, into a twisting position during the course of twisting, can catch particularly well at least a part of the label and incorporate it reliably into the knot during the course of knotting. The label protrudes between the two strands when it touches or intersects a virtual plane that is defined by those sections of the strands that are to be processed to the knot. Preferably, the label intersects the virtual plane on a side of the twisting tool which is facing the material bale, in particular on a side of the twisting hook which is facing the material bale. Since at this side of the twisting tool in general—for example, when using a twisting hook—the major part of the twisted knot is produced, the label in this manner can be engaged particularly well by the strands and held by friction in the finished knot.

Preferably, the label, preferably prior to knotting, has information relating to the material bale written on by means of a writing means. In this manner, a high degree of automation is achieved in the method. In this context, an identifier can be written on the label, and, preferably, logistic data present in a database in regard to the material bale, such as material type, material quality, date/timestamp, production location, weight and/or moisture contents are correlated therewith. Alternatively, logistic data relating to the material bale can be written on the label itself. Preferably, the writing means is connected in a data-transmitting manner for retrieving the required data to a control unit of the material bale press and/or corresponding sensors, for example, weight sensors.

Preferably, in tying devices in which the tying material guided about the material bale is knotted at two positions, wherein a leading knot and a rearward knot are produced in relation to an advancing direction, in particular a pressing direction, of the material bale, the label or a part of the label is incorporated into the rearward knot. The attachment at a rearward knot is advantageous because the knots during the course of the advancing movement have the tendency to bend opposite to the advancing direction. In this context, the leading knots come to rest on the top surface of the material bale while the rearward knots project at the rearward transverse edge laterally away from the material bale so that a label that has been incorporated thereat remains accessible even in case of material bales that are stacked on each other. Alternatively, the label preferably can be incorporated into the leading as well as into the rearward knot. In this manner, the label remains attached safely at the tying material even when one of the knots tears or the label becomes detached from one of the knots.

According to the already afore described as well as farther downwardly described in the following, the aforementioned object is also solved by a marking apparatus for marking a material bale, which is to be tied by means of a tying device with a tying material with production of at least one knot in the tying material, by attaching a label serving as an information carrier to the tying material, in particular for performing a method according to the invention, wherein the marking apparatus is characterized by a storage for labels serving as information carrier as well as a dispensing mechanism which transports a label from the storage into a dispensing position, respectively, wherein in the dispensing position of the label at least one part of the label can be incorporated into the knot during the course of knotting, in particular wherein the marking apparatus is embodied for performing a method according to the invention.

The marking apparatus according to the invention for marking a material bale, which is to be tied by means of a tying device with a tying material for producing at least one knot in the tying material, by attaching a label serving as an information carrier to the tying material is characterized by a storage for labels serving as information carrier as well as a dispensing mechanism that transports a respective label from the storage into a dispensing position. In this context, at least one part of the label can be incorporated into the knot in the dispensing position. For this purpose, the label can be positioned in relation to two strands of the tying material that are to be joined to the knot, in particular sufficiently close to the strands, such that during the course of knotting at least one part of the label is clamped by at least one of the strands or strand sections and/or is clamped, in particular by means of a knotting tool of the tying device, together with at least one of the strands or strand sections, wherein the label in the finished knot is held by friction by at least one of the strands or strand sections.

In this manner, a reliable marking of the material bales is possible in which use is made of the means of the tying devices that are present anyway for joining the two strands of the tying material. For marking, no additional components that move or tension the tying material are thus required, whereby it is possible to save a significant amount of installation space. Preferably, the label is incorporated into the knot only by the means of the tying device present anyway for joining the two strands of the tying material. The marking apparatus must therefore be configured only for supply of the label to the tying device, for example, by a linear movement, and, as needed, for individualizing and/or separating the labels, which requires comparatively little installation space. The transport of the label from the storage into its dispensing position by means of the dispensing mechanism can be realized, for example, mechanically or pneumatically.

Preferably, the labels are manufactured of a tear-resistant material, in particular a tear-resistant plastic material. In this way, it is ensured that the labels withstand the tensile and compression forces that occur during knotting and, moreover, hold reliably during future transport or the storage of the material bales.

In an advantageous embodiment of the invention, the labels each have a transponder that can be read out by radio frequency, in particular an RFID transponder. Such a radio frequency label is still readable and/or writable well even after knotting which causes the label or a part of the label to be possibly significantly deformed. Moreover, radio frequency labels in regard to their function are insensitive in respect to possible soiling that can occur during the manufacturing process of the material bale or the further transport or the storage. Preferably, the transponder is arranged in a read-out region of the label that is not incorporated into the knot and in particular projects away from the finished knot. Preferably, the transponder is embedded by casting in a plastic material in the read-out region or is glued there onto the plastic substrate. In this manner, the transponder is not exposed to the mechanical loads during knotting which reduces or avoids the risk of damage.

Particularly preferred, the marking apparatus comprises a roll with plastic substrate and a roll with a plurality of adhesively connectable transponders in which a certain quantity, in particular a certain length of plastic substrate, as well as a transponder can be paid out from their respective roll and combined so that the transponder is glued onto the plastic substrate. In this manner, the quantity of the plastic substrate used for the respective label can be adapted to the actual requirements and, for example, the length of the label can be varied in this way.

According to a further preferred embodiment of the invention, at least one part of the label, preferably the entire label, is embodied in the form of an elongate piece, in particular in the form of a preferably flexible strip. By such a geometry, the label can be incorporated particularly well into the knot, wherein the elongate piece, so to speak as "third strand", can be supplied to the tying device and processed by the latter. Preferably, at least the part of the label that is to be incorporated into the knot is elongate. In particular, the elongate part of the label or the entire label comprises a length of 10 cm to 50 cm, preferably of 20 cm to 40 cm, particularly preferred of 25 cm to 35 cm. Preferably, at least a part of the label or the entire label has a width of 0.5 cm to 10 cm, preferably 1 cm to 5 cm.

In a further preferred embodiment of the invention, the marking apparatus comprises a guide channel from which a part of the label, in particular at least one fourth of its entire length, preferably at least one third of its entire length, particularly preferred one half of its entire length, protrudes freely when the label is in the dispensing position. In this manner, the label can be positioned particularly well in the vicinity of two strands of the tying material to be joined to the knot, wherein the marking apparatus itself maintains a sufficient distance to the components of the tying device occupying a lot of working space, for example, a twisting hook or a wire pull needle.

Preferably, the guide channel is oriented such in relation to a gravitation direction that the part of the label protruding in the dispensing position extends in an arc shape, in particular wherein the protruding part can bend under its own weight in an arc shape. Since a section of the label, in particular exclusively due to its own weight, extends in an arc shape, the label can be supplied better to the tying device, for example, positioned particularly close to the strands of the tying material, because, as needed, components of the tying device, for example, a twisting hook or wire pull needle, can be bypassed in this way. In this way, for example, even for a guide channel extending transversely to an axis of rotation of the twisting hook, a section of the label can be positioned so as to advance at an angle as acute as possible to one of the strands of the tying material.

Advantageously, the label preferably embodied as a flexible strip is positioned, in particular prior to knotting, such that the label, beginning at a free end of the label that can be brought to face or faces the strands of the tying material, extends in an arc shape at least across a fourth of its entire length, particularly preferred at least across a third of its entire length, particularly preferred across one half of its entire length. Since a section of the label, in particular exclusively due to its own weight, extends in an arc shape, the label can be supplied better to the tying device, for example, positioned particularly close to the strands of the tying material, because, as needed, components of the tying device, for example, a twisting hook or a wire pull needle, can be bypassed in this way.

Preferably, the guide channel is configured such that a retaining force is applied on the label that is in the dispensing position which, on the one hand, is large enough in order to prevent the label from falling out and, on the other hand, small enough such that the label can be pulled out from the guide channel by a pulling force which is acting on it during the course of the tying action. In this way, a reliable supply of the label to the tying device is ensured, wherein the label is prevented from falling out of the marking apparatus at the same time. A retaining force can be applied by a static retaining means such as, for example, a spring element embodied as a leaf spring, or a dynamic retaining means which can be switched between a retaining and a non-retaining position, such as a controllable holding clamp. Alternatively, the geometry of the guide channel can be configured to apply the retaining force, e.g. such that the labels rub against an inner wall of the guide channel during transport.

According to a further preferred embodiment of the invention, the storage of the marking apparatus is a roll with a continuous band of labels wound thereon or a magazine with a plurality of individual labels. In this manner, the labels can be stored and removed in a particularly simple manner. When using a continuous band of labels, the label to be presently dispensed is preferably separated from the band by means of a cutter of the tying device prior to knotting. Alternatively, the material of the band can be weakened-in particular perforated, cut and/or notched-between the individual labels such that upon standstill of the roll the label that is presently to be incorporated into the knot can be separated from the remainder of the band by a pulling force acting on it during the course of knotting. Upon use of a magazine with a plurality of individual labels, the step of cutting can be dispensed with so that the marking apparatus can be produced more simply and requires less installation space.

Preferably, the dispensing mechanism comprises at least one draw roll, in particular a draw roll pair, for the transport of the labels from the storage to the dispensing position. In this way, a transport of the label can be implemented in a constructively simple manner. Alternatively, the dispensing mechanism can be embodied for the pneumatic transport of the labels.

Preferably, in tying devices in which the tying material guided about the material bale is to be knotted at two positions, wherein a leading knot and a rearward knot are produced in relation to an advancing direction of the material bale, the marking apparatus is configured such that the label or a part of the label is incorporated into the rearward knot. The attachment to the rearward knot is advantageous because the knots during the course of the advancing movement have the tendency to bend opposite to the advancing direction. In this context, the leading knots come to rest on the top surface of the material bale while the rearward knots project at the rearward transverse edge laterally away from the material bale so that a label that has been incorporated thereat remains accessible even for material bales that are stacked on each other. Alternatively, the label can be preferably incorporated into the leading as well as rearward knot. In this manner, the label then remains still fastened at the tying material when one of the knots tears or the label becomes detached from one of the knots.

According to the already afore described as well as farther downwardly described in the following, furthermore a material bale press, comprising a tying device for tying a pressed material bale with a tying material with production of at least one knot in the tying material, which is characterized by a marking apparatus according to the invention is subject matter of the invention. In this context, the label in the dispensing position is positioned such in relation to the two strands of the tying material to be joined to the knot, in particular positioned sufficiently close to the strands, so that during the course of knotting at least one part of the label is clamped by at least one of the strands or strand sections and/or, in particular by means of a knotting tool of the tying device, is clamped together with at least one of the strands or strand sections, wherein the label is held by friction by at least one of the strands in the finished knot. All of the advantages described above or to be described in the following of the marking apparatus according to the invention also apply to the material bale press provided therewith. In particular, the material bale press according to the invention is embodied and configured for performing the method according to the invention for marking so that all of the advantages of the method described above as well as to be described in the following apply to it.

According to the already afore described as well as farther downwardly described in the following, furthermore a pressed material bale which is tied with a tying material, wherein the tying material is knotted with at least one knot and a label as an information carrier is fastened to the tying material and which is characterized in that at least one part of the label is incorporated into the knot is subject matter of the invention. The pressed material bale that is tied by a tying material, wherein the tying material is knotted by at least one knot and a label as information carrier is fastened to the tying material, is characterized in that at least one part of the label is incorporated into the knot. In this manner, a particularly reliable and easily recognizable attachment of the label to the material bale is achieved, whereby the material bale can be incorporated better into logistic processes of the waste management industry. For a particularly stable attachment, the knot in which the label is incorporated is preferably a twisted knot. In particular, the pressed material bale is obtained by a method for marking according to the invention.

In a preferred embodiment of the invention, a read-out region of the label, in and/or on which information relating to the material bale is stored or can be stored, is not incorporated into the knot, in particular the read-out region protrudes away from the knot. The read-out region can therefore be better readable and/or writable so that the material bale can be incorporated even better into logistic processes of the waste management industry.

In a further advantageous embodiment of the invention, the label comprises a transponder that can be read out by radio frequency, in particular an RFID transponder. Such a radio frequency label is readable and/or writable even across larger distances. The marked material bale can therefore be identified, for example, when passing a barrier that is provided with a reader, for example, a gate, or manually by a hand-held reader. In this manner, the material bale can be incorporated even better into logistic processes of the waste management industry. Moreover, radio frequency labels with respect to their function are insensitive in relation to possible soiling or weather influences that may occur during the manufacturing process of the material bale or the further transport or the storage. Preferably, the transponder is arranged in a read-out region of the label that is not incorporated into the knot and in particular protrudes away from the finished knot. Preferably, the transponder is embedded by casting into the read-out region in a plastic substrate. In this manner, the transponder can withstand particularly well the loads during transport or the storage of the material bale.

According to a further preferred embodiment of the invention, at least one part of the label, preferably the entire label, is embodied in the form of an elongate piece, in particular in the form of a preferably flexible strip. Due to this geometry, the label can be arranged at the tying material so as to be particularly close and protrude as little as possible. In addition, the label can be held particularly well in the knot, wherein the knot preferably is a twisted knot. Preferably, at least the part of the label that is to be incorporated into the knot is elongate. In particular, the elongate part of the label or the entire label comprises a length of 10 cm to 50 cm, preferably of 20 cm to 40 cm, particularly preferred of 25 cm to 35 cm. Preferably, at least one part of the label or the entire label has a width of 0.5 cm to 10 cm, preferably 1 cm to 5 cm.

As a whole, with the present invention a particularly efficient and reliable marking of material bales is provided that can be retrofitted, in particular due to the excellent simple construction of the marking apparatus, particularly inexpensively in existing material bale presses.

It is expressly noted that the afore explained embodiments of the invention taken respectively alone or in any technically expedient combination can be combined also among each other with the subject matter of one of the independent claims, respectively.

BRIEF DESCRIPTION OF THE DRAWINGS

Modifications and embodiments of the invention as well as further advantages and details of the invention can be taken from the following subject matter description and the drawings. The schematic Figures show in.

Same or similarly acting parts are provided-if expedient—with identical reference characters.

Individual technical features of the embodiments described in the following can be combined also in combination with afore described embodiments as well as the features of the independent claims and possible additional claims to subject matter according to the invention.

DESCRIPTION OF PREFERRED EMBODIMENTS

Figure 1:
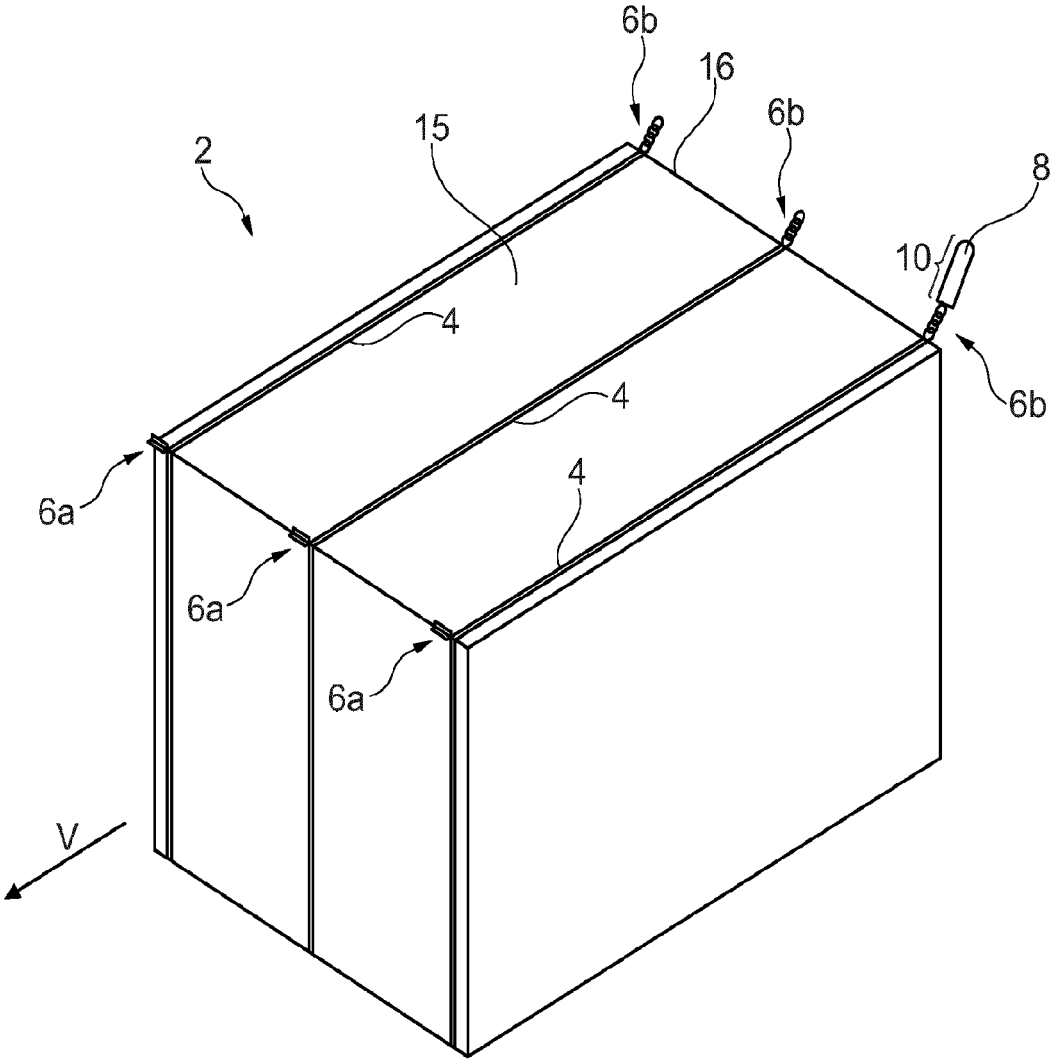
FIG. 1 an embodiment of a material bale according to the invention.

FIG. 1 shows an embodiment according to the invention of a pressed material bale 2 that is tied with three loops of a tying material 4. During knotting, each loop is knotted with a leading knot 6*a* as well as a rearward knot 6*b* in relation to an advancing direction V of the material bale 2. The knots 6*a*, 6*b* are embodied as twisted knots. A label 8 as an information carrier is fastened to the tying material 4, wherein a part of the label 8 is incorporated into one of the rearward knots 6*b*. The attachment at a rearward knot 6*b* is advantageous because the knots 6*a*, 6*b* during the course of the advancing movement have the tendency to bend opposite to the advancing direction V. In this context, the leading knots 6*a* come to rest on the top surface 15 of the material bale 2 while the rearward knots 6*b* project at the rearward transverse edge 16 laterally away from the material bale 2 so that a label 8 which is incorporated thereat remains accessible even for material bales 2 that are stacked on each other.

A read-out region 10 of the label 8 in and/or at which information relating to the material bale 2 are stored or can be stored, is not incorporated into the knot 6*b* and projects away from it for improved readability. In particular, the label 8 is embodied as a radio frequency label with a transponder 12 that is readable by radio frequency, wherein the transponder 12 is arranged in the read-out region 10.

Figure 2:
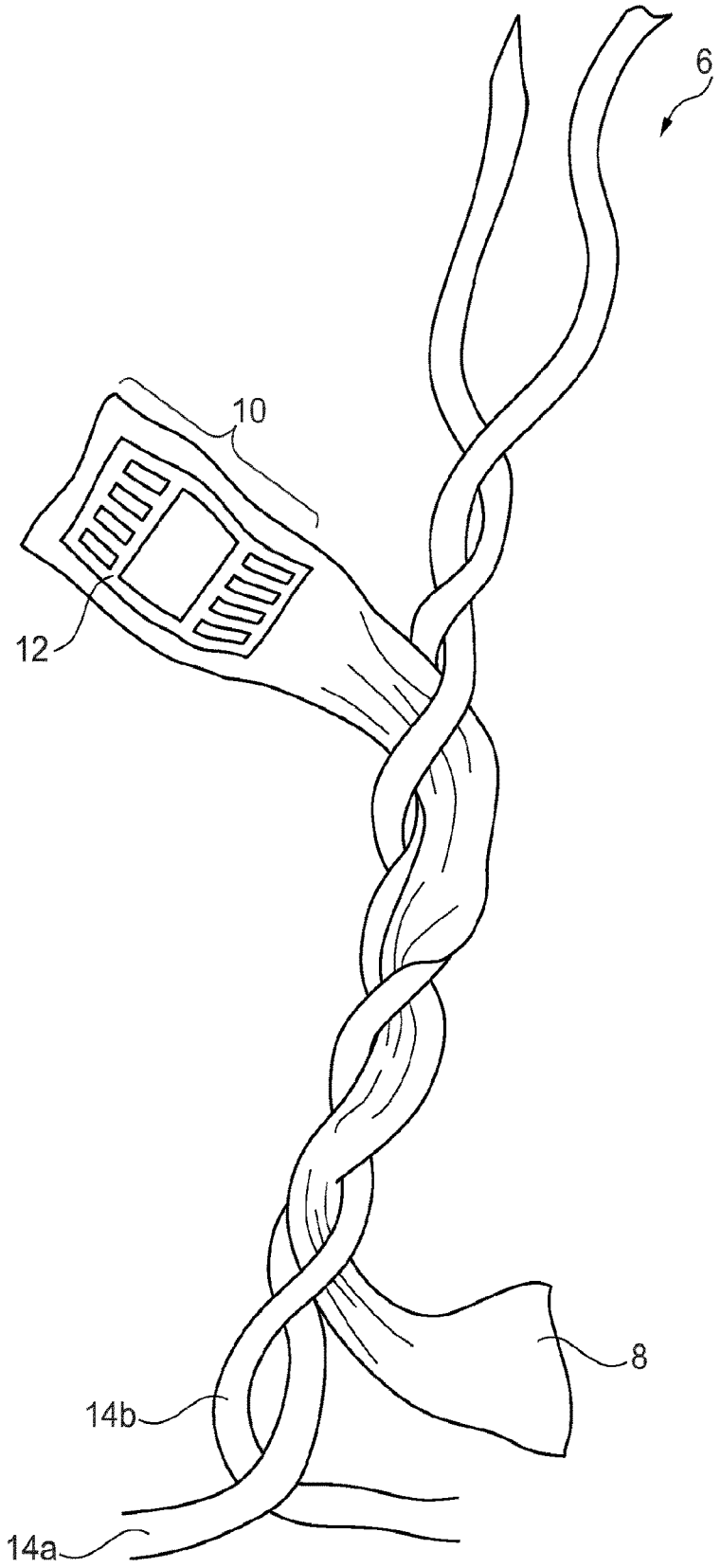
FIG. 2 an embodiment of a label incorporated into a knot.

FIG. 2 shows an embodiment of a knot 6 with label 8 incorporated therein which, for example, can be present in this way in the FIG. 1 embodiment. The label 8 is present as an elongate piece, more precisely in form of a flexible strip. For producing the knot 6, two strands 14*a*, 14*b* of the tying material 4 are twisted to a twisted knot. Into this type of knot, the label 8 can be incorporated particularly well because it is processed in the knot 6 as "third strand" and is thus held by friction at several locations by the windings of the strands 14*a*, 14*b*. The label 8 is configured as a radio frequency label and comprises a transponder 12 which is readable by radio frequency and is arranged in a read-out region 10 of the label 8. The read-out region is not incorporated into the knot 6 and projects for better readability and/or better writability away from the finished knot 6.

Figure 3:
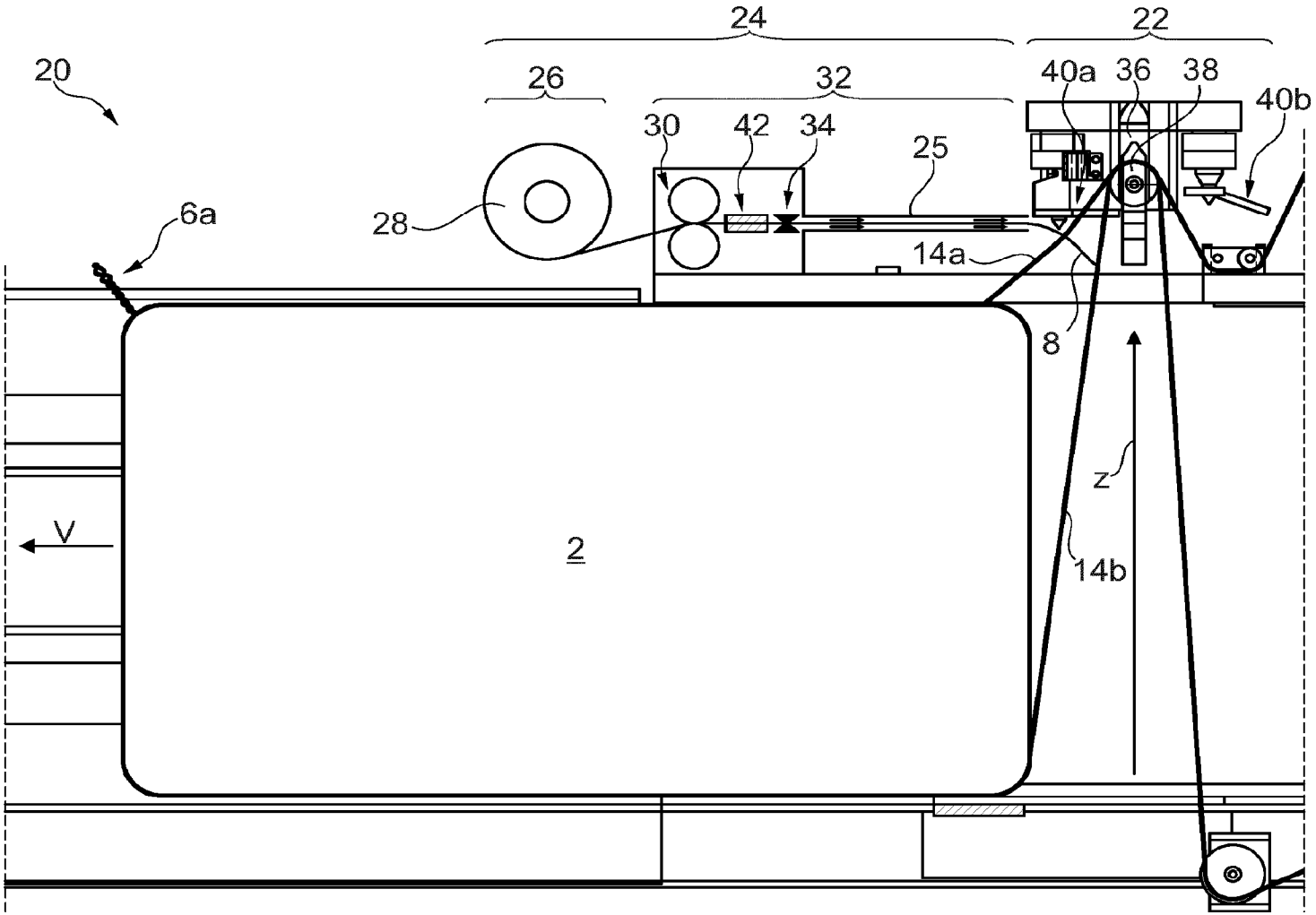
FIG. 3 a tying region of an embodiment of the material bale press according to the invention.
Figure 4:
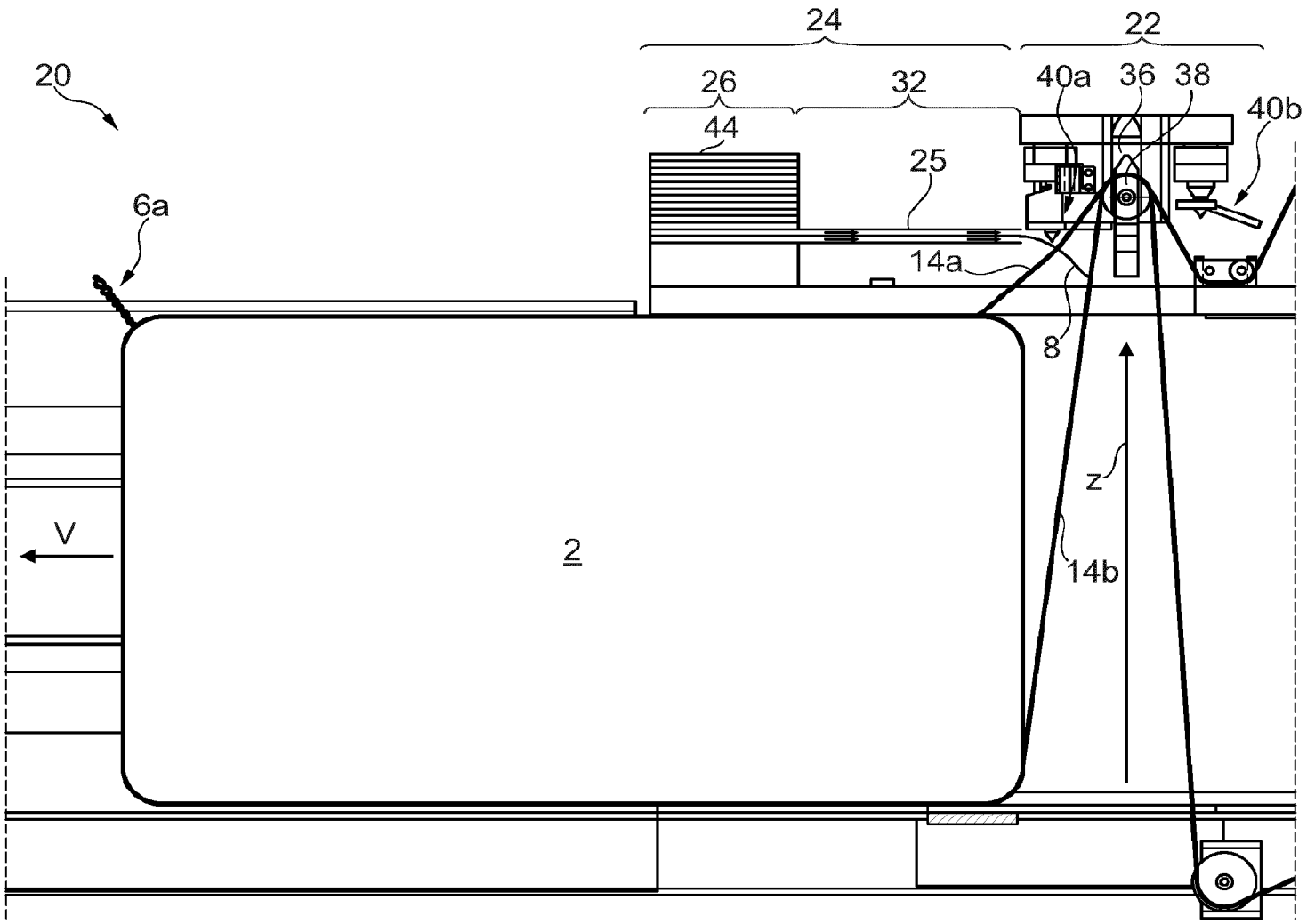
FIG. 4 a tying region of a further embodiment of a material bale press according to the invention.

FIGS. 3 and 4 show tying regions of embodiments of a material bale press 20 according to the invention, comprising a tying device 22 for tying a pressed material bale 2 with a tying material 4. In this context, two strands 14*a*, 14*b* of the tying material 4 present as a wire are knotted, prior to wrapping the material bale 2, to a leading knot 6*a* in relation to the advancing direction V. After having been wrapped around the material bale 2, the two strands 14*a*, 14*b* are knotted to the rearward knot 6*b* (not shown) and the loop is thus tied. The tying device 22 is configured in this context such that the rearward knot 6*b* of the material bale 2 and the leading knot 6*a* for a following bale to be wrapped are simultaneously produced; this is however not illustrated in the Figures. In this context, a first twisting hook 40*a* as well as a second twisting hook 40*b* of the tying device 22 serve respectively for producing a twisted knot, as illustrated in FIG. 2, for example. A marking apparatus 24 with a storage 26 supplies to the tying device 22 individualized labels 8 for incorporation into the rearward knot 6*b* still to be produced. Prior to the knotting action, the strands 14*a*, 14*b* have been combined in a generally known manner by means of a wire pull needle 36 of the tying device 22 moving along the wire pull needle direction Z into a twisting position illustrated here, in which the strands 14*a*, 14*b*, beginning at a deflection roller 38 of the wire pull needle 36, are projecting away in a V-shape. In the here illustrated dispensing position of the label 8, a part of the label 8 protrudes from a guide channel 25 of the marking apparatus 24 and into the vicinity of the sections of the strands 14*a*, 14*b* projecting in a V-shape and to be processed to the rearward knot 6*b*.

In the embodiment illustrated in FIG. 3, the storage 26 of the marking apparatus 24 is in the form of a roll 28 having a continuous band of labels 8 wound thereon. Moreover, the marking apparatus 24 comprises a dispensing mechanism 32 comprising a draw roll pair 30 as well as a reader 42 with which the labels 8 embodied as radio frequency labels can be read out. In this context, an identifier which is located on the respective label 8, for example, an RFID identifier, is detected so that information related to the material bale 2 can be correlated therewith in a database. For separation of the labels 8, the marking apparatus 24 comprises moreover a cutter 34 that separates the label 8 which is momentarily to be supplied to the tying device 22 from the band.

In the embodiment illustrated in FIG. 4, the marking apparatus 24 comprises a storage 26 in the form of a magazine 44 with a plurality of individual labels 8 that are individualized and supplied by a—for example, mechanic or pneumatic-dispensing mechanism 32 of the tying device 22.

Figure 5:
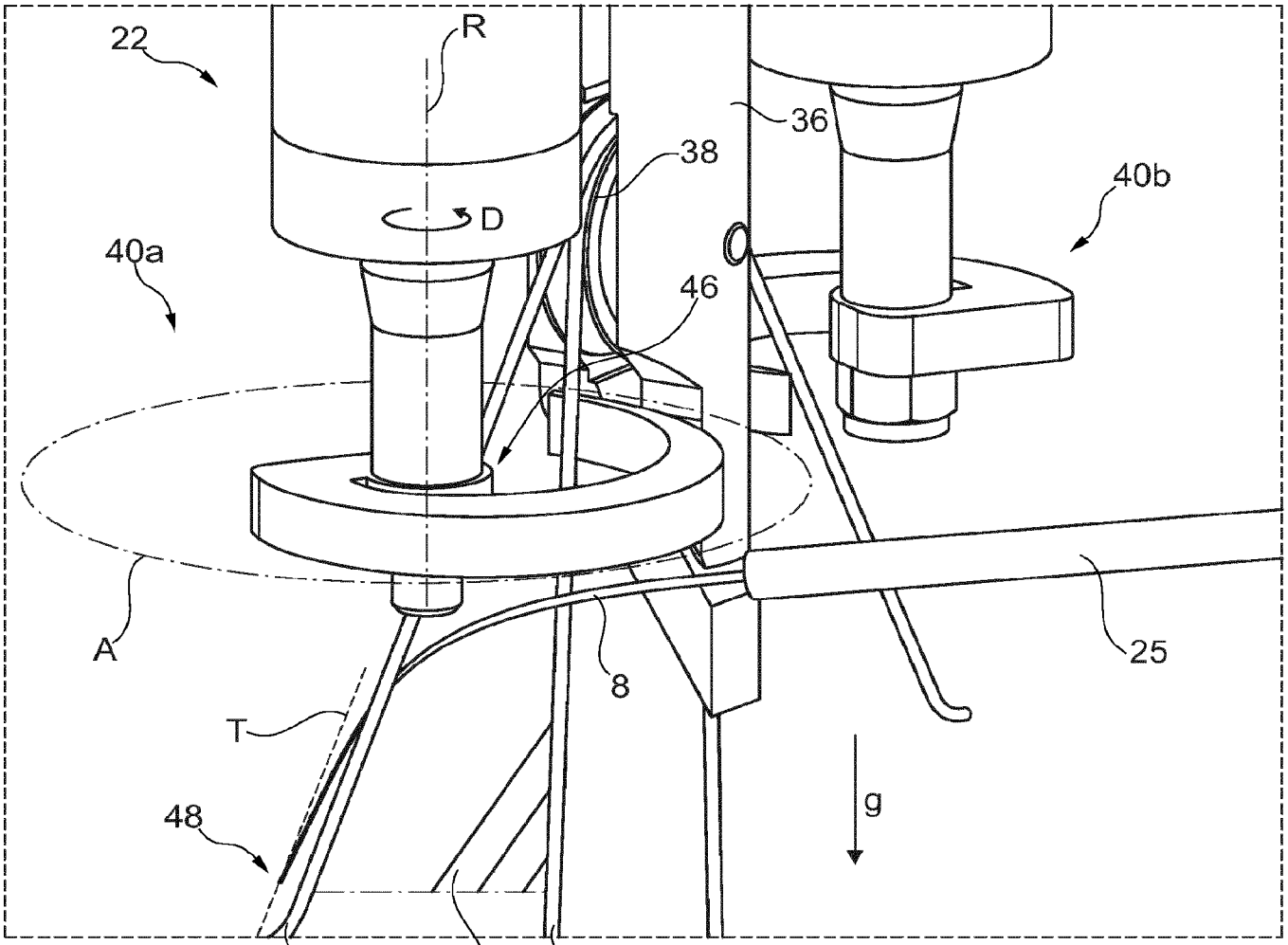
FIG. 5 an embodiment of a label to be supplied to a tying device.

FIG. 5 shows an embodiment of a label 8 supplied to a tying device 22 as it can be existent, for example, in the embodiments according to FIG. 3 and/or FIG. 4. In this context, the label 8, in the dispensing position, protrudes between the two strands 14*a*, 14*b* of the tying material 4 which are to be joined to the rearward knot 6*b*. During the course of knotting, the strands 14*a*, 14*b* are cut through in the region of the deflection roller 38, wherein the first twisting hook 40*a* catches the now freed strands 14*a*, 14*b* by a rotational movement D about a rotation axis R in a catching slot 46 advancing in a spiral shape toward the rotation axis R. Those sections of the strands 14*a*, 14*b* which are located (in this illustration below the twisting hook 40*a*) on the side of the first twisting hook 40*a* facing the material bale 2 (not illustrated here) are combined thereby and twisted by further rotations. In doing so, the label 8 is caught by the strands 14*a*, 14*b* and together with them is incorporated into the twisted knot. Prior to knotting, the label 8 protrudes in such a way between the two strands 14*a*, 14*b* that it intersects or "penetrates" a virtual plane E which is defined by the sections of the strands 14*a*, 14*b* to be knotted on the side of the first twisting hook 40*a* facing the material bale 2 (not illustrated here).

In the dispensing position illustrated in FIG. 5 of the label 8 present as an elongate piece, more precisely as a flexible strip, the guide channel 25 is positioned in relation to a gravitation direction (arrow g) such that a part of the label 8 which is protruding from the guide channel 25 extends in an arc shape due to its own weight. In this manner, components of the tying device 22, such as the twisting hooks 40*a*, 40*b* or the wire pull needle 36, can be bypassed. In this way, even for the guide channel 25 extending substantially transversely to the rotation axis R of the first twisting hook 40*a*, a section of the label 8 can be positioned so as to advance at an angle as acute as possible to one of the strands 14*a*, 14*b* of the tying material 4. Preferably, the label 8 is positioned such in relation to one of the strands 14*a*, 14*b* of the tying material 4 that a virtual tangent T placed at its free end 48, from at least one perspective transverse to the respective strand 14*a*, 14*b*, is positioned relative to the respective strand 14*a*, 14*b* at an angle of smaller or equal to 45°, preferably smaller or equal to 30°, particularly preferred smaller or equal to 20°, so that the label 8 can be supplied particularly well as "third strand" to the tying device 22 as well as gripped by the strands 14*a*, 14*b* and processed.

Figure 6:
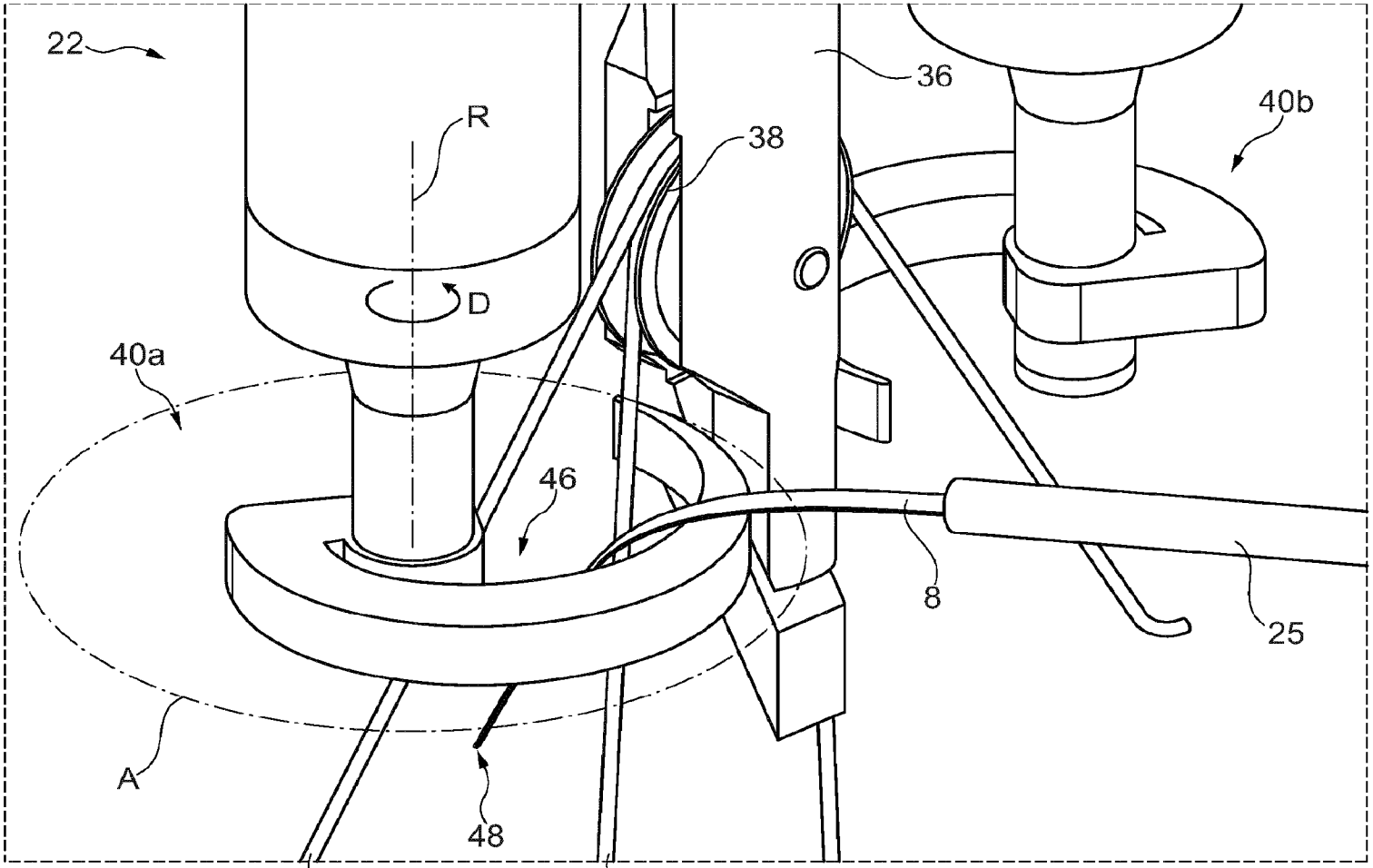
FIG. 6 a further embodiment of a label supplied to a tying device.

FIG. 6 shows an embodiment modified in relation to FIG. 5 that can be existent in this way, for example, in the embodiments according to FIG. 3 and/or FIG. 4 in which the label 8 in the dispensing position protrudes additionally into a working radius A of the first twisting hook 40*a* so that the label 8 during the course of knotting, in which the first twisting hook 40*a* carries out a rotation movement D about its rotation axis R, can be caught in the catching slot 46. In this manner, the first twisting hook 40*a* catches the two strands 14*a*, 14*b* of the tying material 4 as well as the label 8 and combines them optimally, whereby the label 8 is incorporated reliably into the knot 6*b*. In the embodiment illustrated here, the label 8 projects into the catching slot 46 itself. The working radius A is in this context the region into which an object must protrude in order to be caught in the catching slot 46 during the rotation movement D of the twisting hook 40*a* or, when using a different type of twisting tool, to be engaged by the latter.

What is claimed is:

1. A method for marking a material bale, the method comprising:

tying a pressed material bale by a tying device with a tying material wrapped around the material bale by knotting at least one knot in the tying material;

supplying a label as an information carrier to the tying device;

fastening the label to the tying material by incorporating at least one part of the label into the at least one knot.

2. The method according to claim 1, further comprising providing the label with a read-out region configured to store information relating to the material bale and fastening the label such that the read-out region is not incorporated into the at least one knot and projects away from the at least one knot.

3. The method according to claim 1, further comprising providing the label as a radio frequency label comprising a transponder readable by radio frequency.

4. The method according to claim 1, further comprising providing the at least one part of the label or the entire label in the form of an elongate piece or a flexible strip.

5. The method according to claim 1, further comprising twisting at least two strands of the tying material to form the at least one knot as a twisted knot.

6. The method according to claim 5, further comprising:

using a twisting tool for producing the twisted knot;

positioning the label such that the label protrudes into a working radius of the twisting tool so that the label during knotting is caught by and/or in the twisting tool.

7. The method according to claim 5, further comprising:

using a twisting hook with a catching slot for producing the twisted knot;

positioning the label such that the label protrudes into a working radius of the twisting hook so that the label during knotting is caught in the catching slot of the twisting hook.

8. The method according to claim 5, further comprising positioning the label such that the label protrudes between the at least two strands of the tying material.

9. The method according to claim 1, wherein the step of knotting at least one knot includes producing a leading knot and a rearward knot in relation to an advancing direction of the material bale, wherein the at least one part of the label is incorporated into the rearward knot.

10. A marking apparatus for performing the method according to claim 1, the marking apparatus comprising:

a storage configured to store the label serving as information carrier;

a dispensing mechanism configured to transport the label from the storage into a dispensing position, wherein in the dispensing position the at least one part of the label is positioned so as to be incorporated into the at least one knot during knotting of the at least one knot.

11. The marking apparatus according to claim 10, wherein the label comprises a transponder readable by radio frequency.

12. The marking apparatus according to claim 10, wherein the at least one part of the label or the entire label is an elongate piece.

13. The marking apparatus according to claim 10, wherein the at least one part of the label or the entire label is a flexible strip.

14. The marking apparatus according to claim 10, further comprising a guide channel connected to the storage, wherein a portion of the label protrudes freely from the guide channel when the label is positioned in the dispensing position.

15. The marking apparatus according to claim 14, wherein the guide channel is oriented such in relation to a gravitation direction that the portion of the label protruding in the dispensing position extends in an arc shape.

16. The marking apparatus according to claim 14, wherein the guide channel is configured to apply a retaining force on the label positioned in the dispensing position, wherein the retaining force is large enough to prevent the label from falling out of the guide channel but is small enough to permit the label to be pulled out from the guide channel by a pulling force acting on the label during knotting of the at least one knot.

17. The marking apparatus according to claim 10, wherein the storage is a roll having a continuous band of labels wound thereon or the storage is a magazine configured to store a plurality of the label.

18. A material bale press comprising:

a tying device configured to tie a pressed material bale with a tying material by knotting at least one knot in the tying material; and a marking apparatus for performing the method according to claim 1, the marking apparatus comprising:

a storage configured to store the label serving as information carrier;

a dispensing mechanism configured to transport the label from the storage into a dispensing position, respectively, wherein in the dispensing position the at least one part of the label is positioned so as to be incorporated into the at least one knot during knotting of the at least one knot.

19. A pressed material bale tied with a tying material, wherein the tying material comprises at least one knot, wherein a label as an information carrier is fastened to the tying material, wherein at least one part of the label is incorporated into the at least one knot.

20. The pressed material bale according to claim 19, wherein the label comprises a read-out region configured to store information relating to the pressed material bale, wherein the read-out region is not incorporated into the at least one knot and projects away from the at least one knot.

21. The pressed material bale according to claim 19, wherein the label comprises a transponder readable by radio frequency.

22. The pressed material bale according to claim 19, wherein the at least one part of the label or the entire label is elongate piece.

23. The pressed material bale according to claim 19, wherein the at least one part of the label or the entire label is a flexible strip.

* * * * *